US009168734B2

(12) United States Patent
Rancourt et al.

(10) Patent No.: US 9,168,734 B2
(45) Date of Patent: Oct. 27, 2015

(54) SYSTEM AND METHOD FOR PREVENTING HIGH TENSION FROM DAMAGING A PRINTING PRESS

(71) Applicant: Goss International Americas Inc., Durham, NH (US)

(72) Inventors: Michael Raymond Rancourt, Merrimack, NH (US); Ronald Billmen Robert, Gonic, NH (US)

(73) Assignee: Goss International Americas, Inc., Durham, NH (US)

( * ) Notice: Subject to any disclaimer, the term of this patent is extended or adjusted under 35 U.S.C. 154(b) by 26 days.

(21) Appl. No.: 14/047,556

(22) Filed: Oct. 7, 2013

(65) Prior Publication Data

US 2014/0182469 A1 Jul. 3, 2014

Related U.S. Application Data

(60) Provisional application No. 61/746,880, filed on Dec. 28, 2012.

(51) Int. Cl.

| | |
|---|---|
| ***B65H 26/04*** | (2006.01) |
| ***B41F 33/18*** | (2006.01) |
| ***B41F 33/06*** | (2006.01) |
| ***B41F 13/03*** | (2006.01) |
| *B41F 33/04* | (2006.01) |

(52) U.S. Cl.

CPC ..... *B41F 33/18* (2013.01); *B41F 13/03* (2013.01); *B41F 33/06* (2013.01); *B65H 26/04* (2013.01); *B41F 33/04* (2013.01); *B41P 2233/20* (2013.01); *B65H 2301/5151* (2013.01); *B65H 2515/31* (2013.01); *B65H 2601/26* (2013.01)

(58) Field of Classification Search

None

See application file for complete search history.

(56) References Cited

U.S. PATENT DOCUMENTS

| | | | | |
|---|---|---|---|---|
| 2,983,463 | A * | 5/1961 | Rockstrom et al. | 242/421.4 |
| 3,928,844 | A * | 12/1975 | Meihofer | 226/11 |
| 4,000,888 | A | 1/1977 | Gardner et al. | |
| 4,078,487 | A * | 3/1978 | McComb | 101/228 |
| 4,667,946 | A * | 5/1987 | Taguchi et al. | 270/52.11 |
| 5,269,222 | A * | 12/1993 | Johnson et al. | 101/228 |
| 6,009,421 | A * | 12/1999 | Xie et al. | 706/61 |
| 6,507,832 | B1 * | 1/2003 | Evans et al. | 706/61 |

* cited by examiner

*Primary Examiner* — Jill Culler

(74) *Attorney, Agent, or Firm* — Davidson, Davidson & Kappel, LLC

(57) ABSTRACT

A method of preventing damage in a printing press is provided. The method includes determining a minimum value at which tension in a web in the printing press is capable of damaging at least one web contacting component of the printing press; sensing a tension in the web in the printing press; and severing the web when the sensed tension reaches the minimum determined tension value. A printing press is also provided.

16 Claims, 1 Drawing Sheet

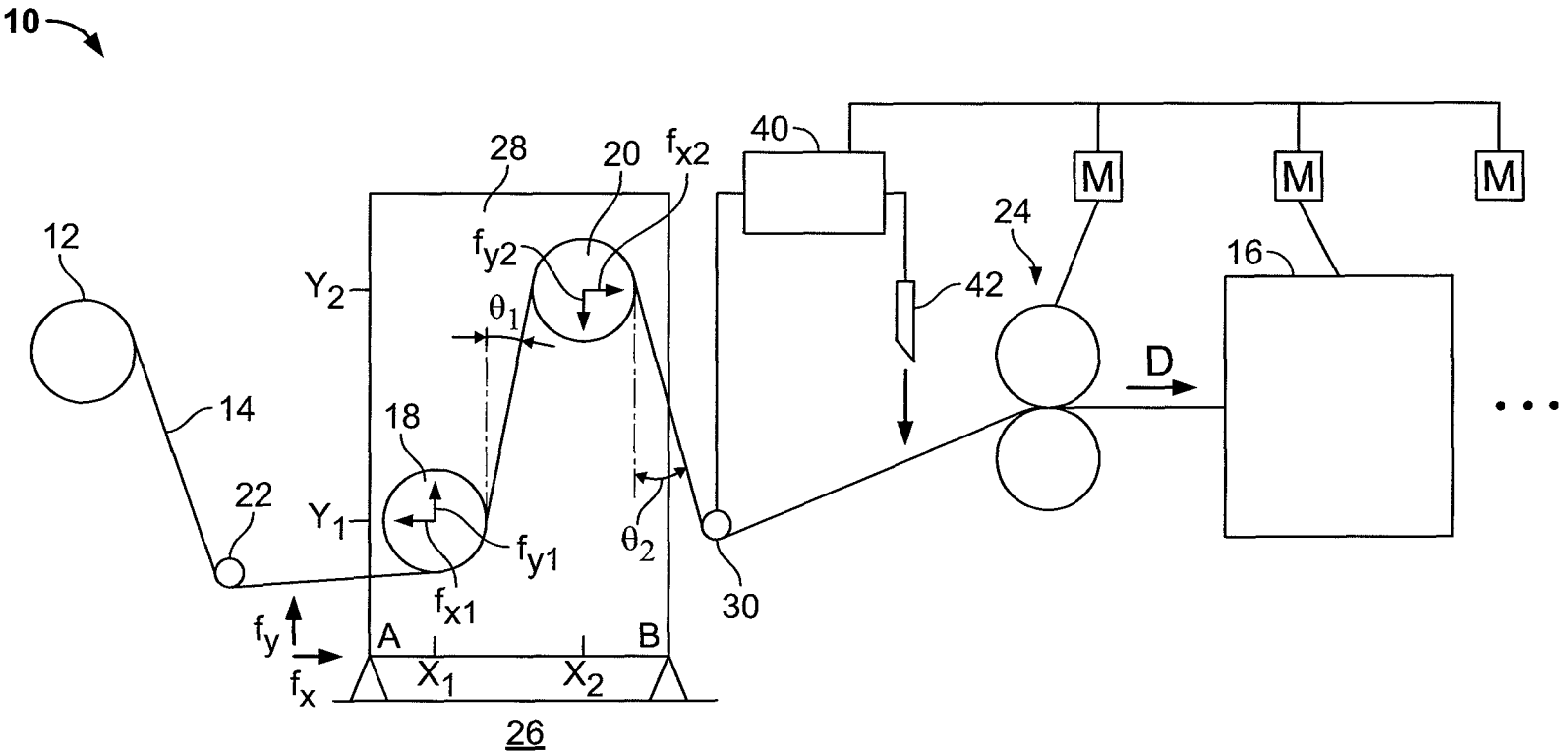
10
12
14
22
Y2
Y1
28
20
18
fx2
fy2
θ1
fy1
fx1
A
X1
X2
B
26
fy
fx
θ2
30
40
42
24
M
M
M
16
D

SYSTEM AND METHOD FOR PREVENTING HIGH TENSION FROM DAMAGING A PRINTING PRESS

This application claims priority to U.S. Provisional Patent Application Ser. No. 61/746,880 filed Dec. 28, 2012, the entire disclosure of which is hereby incorporated by reference.

The present invention relates generally to printing presses and more specifically to a system and method for preventing high tension from damaging a printing press.

BACKGROUND

Printing presses, in particular packaging printing presses, may include equipment that is unprotected from excessive web forces, which may be generated when using thick or strong substrates, for example cardboard.

SUMMARY OF THE INVENTION

A method of preventing damage in a printing press is provided. The method includes determining a minimum value at which tension in a web in the printing press is capable of damaging at least one web contacting component of the printing press; sensing a tension in the web in the printing press; and severing the web when the sensed tension reaches the minimum determined tension value.

A printing press is also provided. The printing press includes at least one unit printing on or processing a web; at least one web contacting component contacting the web; at least one sensor for sensing a tension in the web; a web severer for severing the web; and a controller connected to the at least one sensor and to the web severer, the controller configured and arranged to receive the sensed tension from the at least one sensor and instruct the web severer to sever the web when the sensed tension reaches a minimum value at which tension in the web is capable of damaging the at least one web contacting component.

BRIEF DESCRIPTION OF THE DRAWINGS

The present invention is described below by reference to the following drawing, in which:

FIG. 1 shows a printing press according to an embodiment of the present invention.

DETAILED DESCRIPTION

Extremely high tension conditions brought about by isolated print system substrate transport module failures have resulted in extremely high tensions when using web substrates, particularly cardboard. The excessive web forces may cause the unprotected equipment to be dislodged from pressroom mounts, resulting in serious injury and/or equipment damage. Equipment with wrapped rolls may have forces applied to them that are not neutral in nature. The forces can be such that the equipment may be pulled over by the very high tension which can be applied to the equipment by the substrate during a system failure. For example, a splicer may brake and/or a motor driving the web may reverse direction with the press running, quickly inducing a large tension spike in the web. The web in such a condition acts as a pull chain or rope on the equipment until the web reaches its tension threshold (i.e., burst strength) and the web breaks or until a moment arm formed on the equipment by the web wrap and high tension force exceeds the lateral force which can be tolerated by the equipment mounts and the web pulls the equipment over.

Equipment pull over problems may be addressed by monitoring tension on rolls which are wrapped in such a way that a pull over condition may result with tension transducers and a system to sever the web. By sensing tension with a tension transducer a press operator can set a limit below a maximum machine lateral force which is tolerable by the machine mount. Once the tension reaches the maximum machine lateral force, a machine controller triggers a fast acting web server to cut the substrate before the equipment is forced over by the web of a component is dislodged from a mount thereof and a catastrophic failure occurs.

FIG. 1 shows a printing press 10 according to an embodiment of the present invention. Printing press 10 includes an unwinding unit 12 feeding a web 14 in a web direction D to at least one schematically shown unit 16, which may be at least one printing unit, for example a web offset lithographic printing unit, or at least one processing unit, for example a folder. In this embodiment, printing press 10 is a packing printing press and web 14 is packaging substrate, for example cardboard. At least one web contacting component, which in this embodiment are rolls 18, 20 receive web 14 at guide web 14 to unit 16. Web 14 wraps around a portion of an outer circumference of each of rolls 18, 20. One or more additional web contacting components, such as roll or bar 22 upstream of rolls 18, 20 and roll pair 24 downstream of rolls may also be provided to help guide and transport web 14. Rolls 18, 20 may be mounted on a floor 26 by a mount 28 at supports A, B of mount 28. Roll pair 24, printing unit 16, and other press components may be driven by motors M as is known in the art.

As shown in FIG. 1, tension in web 14 may generate forces on web 14, for example, forces fx1 and fy1 on roll 18 and forces fx2 and fy2 on roll 20. At extreme tensions of web 14, the net forces on rolls 18, 20, particularly the lateral forces in the x-direction, may act to damage rolls 18, 20 by pulling rolls 18, 20 and mount 28 over. Also, rolls 18, 20 may be damaged by the forces on one or both of rolls 18, 20 causing rolls 18, 20 to dislodge from mount 28.

At least one sensor 30 may be provided to sense at least one tension in web 14. In the embodiment shown in FIG. 1, sensor 30 is a transducer is provided downstream of rolls 18, 20; however, in other embodiments, one or more transducers may be provided at roll or bar 22 and/or between rolls 18, 20 in addition to or in place of transducer 30 to sense tensions in web 14. Printing press 10 also includes a controller 40 for receiving signals indicating the sensed tension or tensions from one or more transducers 30 and instructing a web severer 42 to sever web 14 if a minimum value at which the tension or tensions in 14 in the printing press is capable of damaging at least one of rolls 18, 20. Web severer 42, which is schematically shown in FIG. 1, may include an actuator, a blade and an anvil.

Controller 40 can, for example, be one or more programmable logic controller(s) (PLC), or any suitable hardware based or software based electronic controller or controllers including, for example, one or more microcomputers with related support circuitry, one or more finite static machine(s), one or more field programmable gate array(s), FPGA, or one or more application-specific integrated circuit(s), ASIC, among others. Although a single controller 40 is show, it should be understood that controller 40 can itself be comprised of a plurality of controllers as is known in the art.

Controller 40 may determine the minimum value at which the tension or tensions in web 14 generates sufficient forces at one or more of rolls 18, 20 to damage one or more of rolls 18, 20, for example by either dislodging one or more of rolls 18, 20 from mount 28 or by toppling mount 28 over. For example, controller 40 may maintain a database specifying minimum tensions as a function of web characteristics such as material, weight, thickness, width, and/or modulus of elasticity. The yield limit of press mechanical mounts, and moment arms formed by the substrate through the press can be used to calculate the point at which a mechanical mount might fail. Controller may also directly measure the forces fx1 or fx2 with sensors, or estimate these forces based on empirical data.

In another embodiment, an operator of press 10 may determine the minimum value at which the tension or tensions in web 14 generates sufficient forces at one or more of rolls 18, 20 to damage one or more of rolls 18, 20 and input the minimum value into controller 40.

In one exemplary embodiment, the tension is measured using the tension transducers that are already provided in the printed press for automatic tension control. In this regard, web printing press tension control systems include tension transducers that are integrated to the motion controller(s) on the press. These tension control systems in the motion controller(s) continually monitor web tension and control the speed of various components of the press such as cylinders and rollers to maintain web tension within desired setpoints. In accordance with an embodiment of the present invention, the motion controller(s) would signal the system controller (for example a PLC) that there is an over tension event occurring. The system controller, in turn, would respond to this alert by instructing the web severer(s) 42 to sever the web, thereby averting a catastrophic event to press equipment. In accordance with another or further embodiment of the present invention, in addition to instructing the severer(s) 42 to sever the web, the motion control system could attempt to apply maximum torque to stop or reverse (in the case of equipment can run in reverse without damage) the motion of selected motors (M) in the press 10.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method of preventing damage in a printing press comprising:

determining a minimum value at which tension in a web in the printing press is capable of damaging at least one web contacting component of the printing press;

sensing a tension in the web in the printing press;

severing the web when the sensed tension reaches the minimum determined tension value.

2. The method as recited in claim 1 wherein the tension in the web is sensed by at least one transducer.

3. The method as recited in claim 1 wherein the at least one web contacting component is upstream of at least one unit printing on or processing the web.

4. The method as recited in claim 1 wherein the at least one web contacting component includes at least one roll, the web being wrapped around a portion of an outer circumference of the at least one roll.

5. The method as recited in claim 1 wherein a printing press controller determines the minimum value at which tension in the web is capable of damaging the at least one web contacting component, receives a signal indicating the sensed tension and instructs a web severer to sever the web.

6. The method as recited in claim 5 wherein the printing press controller instructs one or more motors in the press to stop.

7. The method as recited in claim 5 wherein the printing press controller instructs one or more motors in the press to reverse direction.

8. The method as recited in claim 1 wherein the minimum value at which tension in the web is capable of damaging the at least one web contacting component is a value at which the tension in the web pulls a mount supporting the at least one web contacting component over or dislodges the at least one web contacting component from the mount supporting the at least one web contacting component.

9. A printing press comprising:

at least one unit printing on or processing a web;

at least one web contacting component contacting the web;

at least one sensor for sensing a tension in the web;

a web severer for severing the web;

a controller connected to the at least one sensor and to the web severer, the controller configured and arranged to receive the sensed tension from the at least one sensor and instruct the web severer to sever the web when the sensed tension reaches a minimum value at which tension in the web is capable of damaging the at least one web contacting component.

10. The printing press as recited in claim 9 wherein the at least one sensor is a transducer.

11. The printing press as recited in claim 9 wherein the at least one web contacting component is upstream of the at least one unit printing on or processing the web.

12. The printing press as recited in claim 9 wherein the at least one web contacting component includes at least one roll, the web being wrapped around a portion of an outer circumference of the at least one roll.

13. The printing press as recited in claim 9 wherein the controller determines the minimum value at which tension in the web is capable of damaging the at least one web contacting component.

14. The printing press as recited in claim 9 wherein the minimum value at which tension in the web is capable of damaging the at least one web contacting component is a value at which the tension in the web pulls a mount supporting the at least one web contacting component over or dislodges the at least one web contacting component from the mount supporting the at least one web contacting component.

15. The method as recited in claim 9 wherein the printing press controller instructs one or more motors in the press to stop based on the sensed tension.

16. The method as recited in claim 9 wherein the printing press controller instructs one or more motors in the press to reverse direction based on the sensed tension.

* * * * *